United States Patent [19]

Skidmore

[11] 3,932,567

[45] Jan. 13, 1976

[54] GAS AERATING CARBURETOR

[76] Inventor: Paul E. Skidmore, 2941 E. McDowell Road, Phoenix, Ariz. 85008

[22] Filed: July 5, 1974

[21] Appl. No.: 485,973

[52] U.S. Cl. ..... 261/30; 261/52; 261/84; 48/180 S; 259/DIG. 30

[51] Int. Cl.[2] ..... F02M 17/16

[58] Field of Search ..... 48/180 S, 180 R; 261/28, 261/84, 52, 30, 83, 90; 259/DIG. 30

[56] References Cited

UNITED STATES PATENTS

| | | | |
|---|---|---|---|
| 843,554 | 2/1907 | Schrader | 261/52 |
| 1,174,529 | 3/1916 | Sykes | 48/180 R |
| 1,594,711 | 8/1926 | Chapman | 48/180 S |
| 1,619,309 | 3/1927 | Pagett | 261/28 |
| 1,866,473 | 7/1932 | Kummerer | 48/180 R |
| 1,933,648 | 11/1933 | Yoder | 48/180 R |
| 2,159,400 | 5/1939 | Preston | 261/90 |
| 2,234,921 | 3/1941 | Webb | 261/83 |
| 3,297,305 | 1/1967 | Walden | 48/180 R |
| 3,326,538 | 6/1967 | Merritt | 261/DIG. 51 |
| 3,853,515 | 12/1974 | Davis | 261/90 |

FOREIGN PATENTS OR APPLICATIONS

| | | | |
|---|---|---|---|
| 107,897 | 7/1917 | United Kingdom | 48/180 |

*Primary Examiner*—Tim R. Miles
*Attorney, Agent, or Firm*—Warren F. B. Lindsley

[57] ABSTRACT

A power driven gas aerating carburetor for supplying the combustion chambers of an internal combustion engine with finely atomized air-fuel mixtures in controlled proportions under pressure for more thorough combustion of the air-fuel mixtures.

4 Claims, 4 Drawing Figures

GAS AERATING CARBURETOR

BACKGROUND OF THE INVENTION

This invention pertains to fuel aerating devices or apparatus which is utilized to supply the combustion chambers of an internal combustion engine with a volatile air-fuel mixture, and more particularly to a power driven device or gas aerator which is capable of providing an uninterrupted flow of finely atomized highly volatile air-fuel mixtures to the combustion chambers of the engine, under pressure and in direct proportion to the requirements of the engine.

DESCRIPTION OF THE PRIOR ART

Heretofore, the necessary supply of a volatile air-fuel mixture required for the operation of an internal combustion has been furnished in atomized form to the combustion chambers of the engine by conventional one, two or four barrel carburetor. These carburetors in conjunction with suitable automatic or manually operated control mechanism regulate the atomization and the amount of the air-fuel mixture required to operate the engine regardless of the load or speed requirements imposed on the engine.

Most of the fuel supply systems, including the conventional carburetors used for powering the engines of motor vehicles have been inefficient in their use of fuel and consequently results in air pollution due to incomplete combustion of the fuel within the engine. This occurs principally because the carburetor components fail to efficiently atomize the mixture of air and fuel for complete combustion in the cylinders of the engine.

SUMMARY OF THE INVENTION

Therefore, a need exists for a new and improved power driven gas aerator carburetor for the fuel supply system of an internal combustion engine which is capable of furnishing the combustion chambers of the engine with the required quantities of highly vaporized, volatile air-fuel mixtures regardless of the load or speed requirements imposed on the engine.

It is, therefore, one object of this invention to provide a new and improved gas aerator or air-fuel mixing device that may be utilized in conjunction with other standard components of a fuel supply system of an internal combustion engine which will furnish a variable supply of thoroughly mixed, finely atomized air and fuel having the characteristics necessary to support complete combustion of the fuel in the engine.

Another object of this invention is to provide an improved gas aerator or air-fuel mixing device which is simple in design and construction and comparatively inexpensive to fabricate and which is capable of supplying the cylinders or combustion chambers of an internal combustion engine with variable amounts of properly proportioned, pre-combined air and fuel mixtures, under pressure in accordance with the load and speed requirements of the engine.

A further object of this invention is to provide an improved power driven cylindrical gas aerator or air-fuel mixing device utilized for pre-mixing air and liquid fuel into a finely atomized gaseous mixture that is forced under pressure through cylindrical aerator with the assistance of a partial vacuum created in the air-horn of the intake manifold of an internal combustion engine.

Further objects and advantages of this invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawing, in which.

DESCRIPTION OF THE PREFERRED EMBODIMENT

Figure 1:
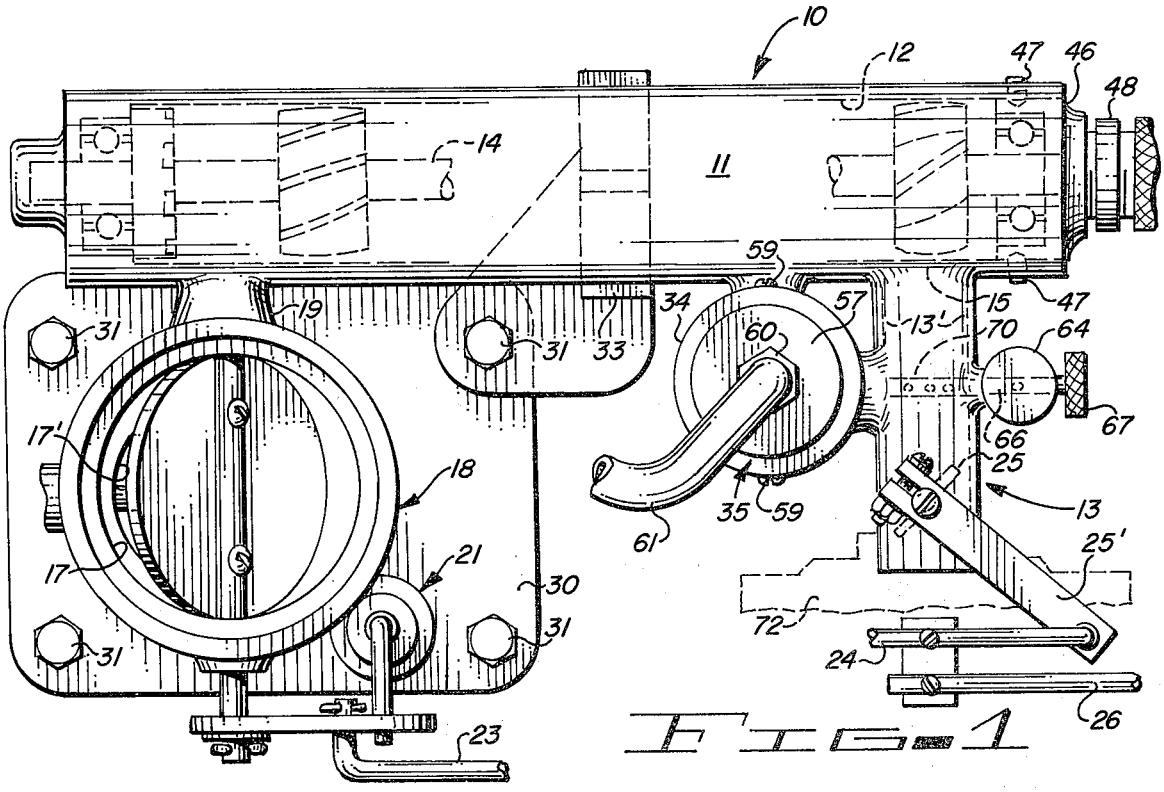
FIG. 1 is a plan view of the gas aerator of this invention showing it in relationship to the other components of the fuel system of an internal combustion engine.
Figure 2:
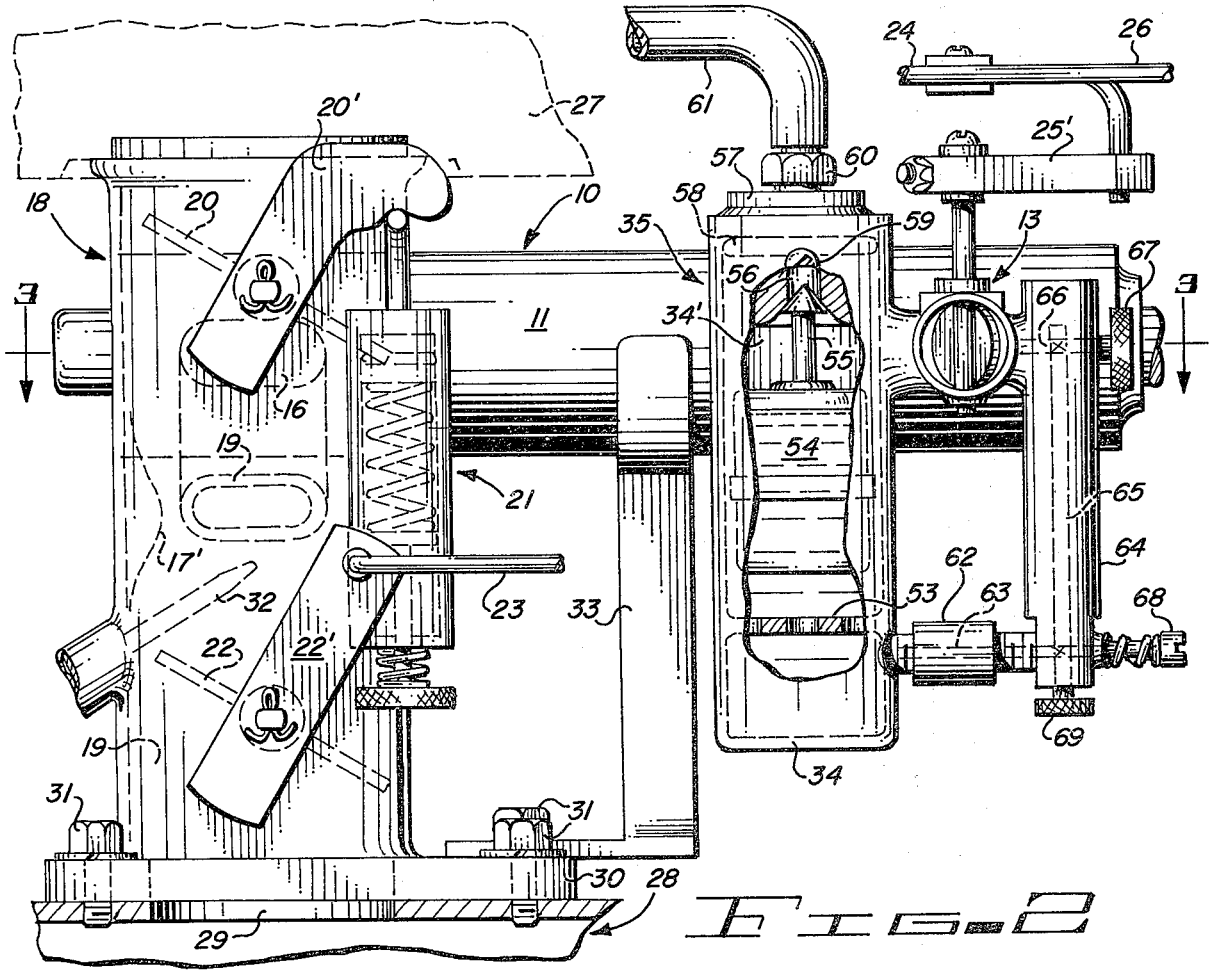
FIG. 2 is a fragmentary side elevational view, partly broken away and in section, of the gas aerator shown in FIG. 1 together with its associated components.

Referring more particularly to the drawing by characters of reference, FIGS. 1 and 2 illustrate one arrangement of the several components of a fuel aerating system for an internal combustion engine in which the gas aerator assembly 10 comprises a cylindrical housing or casing 11 having a finely finished bore 12 that is closed at one end and open at the other end. A small diameter air-horn 13 preferably integral with the aerator casing 11 and extending outwardly therefrom in perpendicular relationship thereto is provided for a secondary air supply and is connected at its intersection with casing 11 by an opening 15 which interconnects bore 12 and the hollow interior of air-horn 13.

Closely adjacent the closed end of the aerator casing 11 and in parallel alignment with air-horn 13 is provided a larger air-horn 18. The hollow interior of air-horn 18 is interconnected with bore 12 of casing 11 by an opening 16 in casing 11 which is preferably elongated in shape and adapted to communicate with the inside bore 17 of air-horn 18 through a hollow connector piece 19 as shown in FIG. 1.

The large air-horn 18 is similar in most respects to the air-horns usually provided in convential carburetors employing a pair of rotatable disc like butterfly valves 20 and 22. Both of these valves are mounted to rotate independently in the cylindrical bore 17 of the air-horn and are spaced midway above and below the reduced diameter or venturi portion 17' of the air-horn. The upper butterfly valve 20, lever arm 20' and suitable linkage are adapted to be rotated by the usual automatic choke 21. The lower butterfly valve 22 is adapted to be rotated by a lever arm 22' pivotally connected to a throttle control rod 23. Rod 23 is interconnected by suitable linkage (not shown) to another control rod 24 and lever arm 25'. Lever arm 25' is adapted to rotate a small butterfly valve 25 notably mounted in bore 13' adjacent the open end of the small secondary air-horn 13. Whenever the accelerator control rod 26 is activated, both the large throttle valve 22 and the small throttle valve 25 will be opened or closed simultaneously to provide the same degree of opening or closure in their respective housings.

The cylindrical bore 17 of the large air-horn 18 is open at both ends and communicates at its top end with the atmosphere through a suitale air cleaner 27 indicated in dash line in FIG. 1. The bottom end of the air-horn communicates with the intake manifold 28 of the engine through an opening 29 formed in the flat, top horizontal wall surface of the manifold and is rigidly attached in perpendicular and leak proof relationship thereto by an integrally formed flange 30 and a plurality of threaded studs 31. Air-horn 18 is also provided with an atomizing nozzle 32, the open end of which projects into the center of the bore 17. The other end of nozzle 32 is connected by tubing to an auxiliary fuel pump (not shown) which is operated by the accelerator to supply gas to the interior of the air-horn for engine starting purposes hereinafter explained.

One of studs 31 may be used too rigidly secure the base portion of a support bracket 33 in perpendicular relationship to the top flat surface of the extending flange 30 and the top flat surface of the intake manifold 28. Thus, when the cylindrical casing 11 of the gas aerator assembly 10 is supported in the semicircular top portion of the support bracket 33, the central axis 14 of the aerator assembly will lie in a horizontal parallel plane to the flat top surface of the intake manifold 28. Air-horns 13 and 18 and cylindrical casing 34 of a float assembly 35 are supported by the cylindricl walls of the aerator casing 11 as shown in FIGS. 1, 2 and 3 of the drawings.

Figure 3:
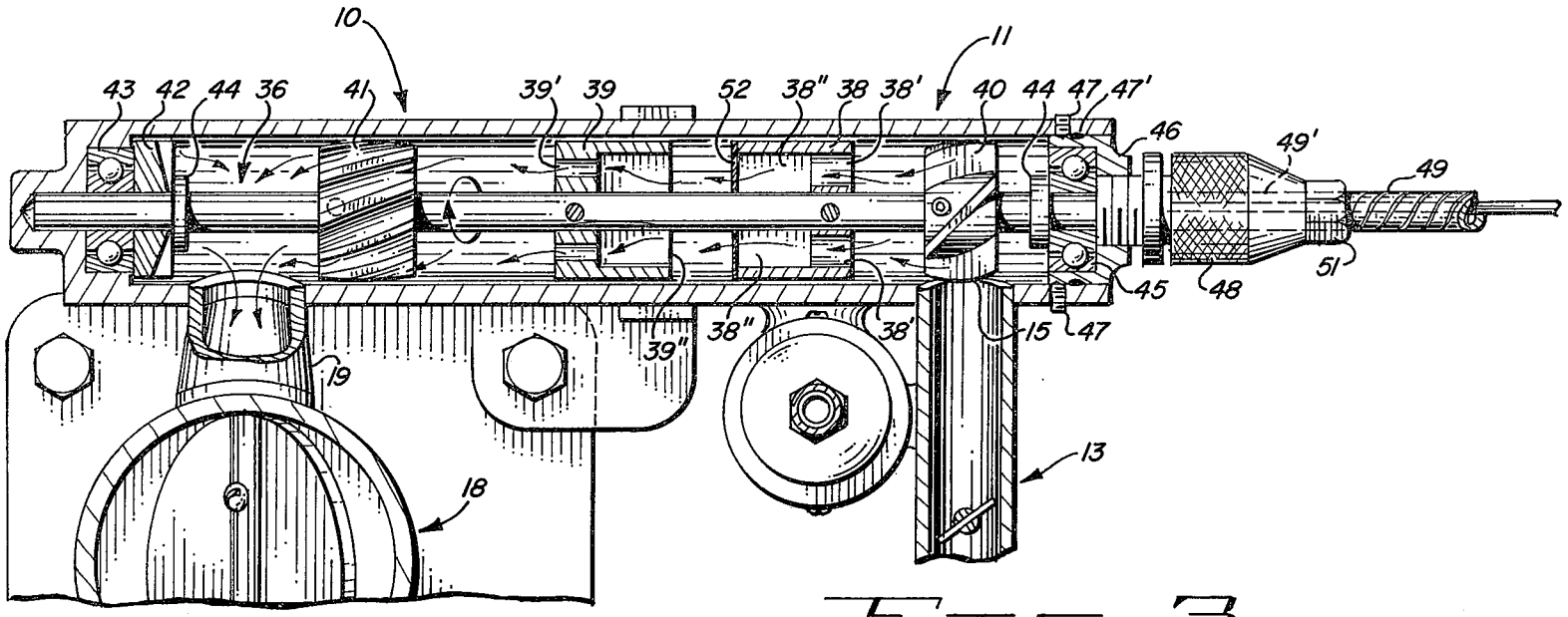
FIG. 3 is a fragmentary sectional plan view taken on line 3—3 of FIG. 2 through the gas aerator illustrating the relationship of the internal parts of the same in respect to other components of the fuel system.
Figure 4:
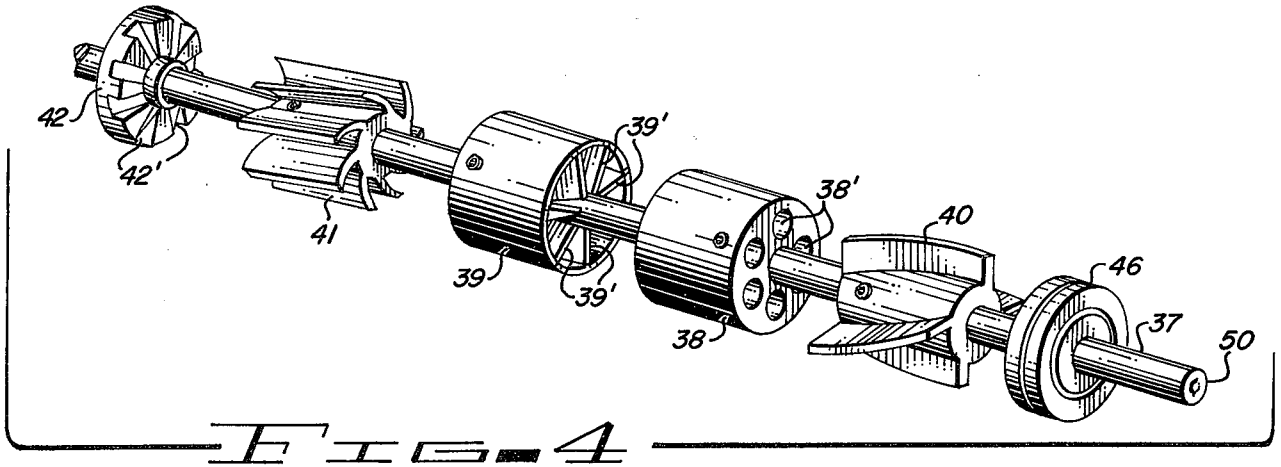
FIG. 4 is a perspective view of the internal drive shaft assembly with its several attached components completely removed from the gas aerator's cylindrical casing and detached from the flexible drive shaft shown in FIG. 3.

The gas aerator assembly 10 further comprises a removable, rotatable aerator shaft assembly 36 that consists of a central shaft member 37 having cylindrical aerator members 38 and 39 and fan or impeller member 40 and 41 securely attached thereto in spaced relation with each other (as shown in FIGS. 3 and 4) by means of suitable keys and keyways or set screws so that they may be removed and replaced if necessary.

Shaft 37 extends rearwardly through the central bore of a comparatively thin cylindrical aerator member 42 which is securely fixed to the shaft in non-rotative relationship and into a clearance bore in the closed end of the cylindrical aerator casing 11 where it is journaled in a suitable bearing 43. The entire shaft assembly 36 is limited in its relative axial movement by one of a pair of thrust washers 44 that are removably attached to the shaft in any convenient manner.

The front end of shaft 37 is journaled in a suitable bearing 45 in a central counterbore of the cylindrical end closure member 46 of casing 11 by means of set screws 47, and an O-ring 47' and through a central bore of a connector member 48 screwed into a threaded aperture in the outer face of the closure member 46. At this point it is connected to the square exposed end of an inner rotatable element 49' of a flexible shaft 49 by the insertion of element 49' in a square aperture 50 formed in the front end of the shaft where it is secured therein in driving relationship by a lock nut 51.

The other exposed square end of the flexible shaft 49 is secured in driven relationship to a suitably sized pulley wheel (not shown) that is secured in rotative relationship to the forward end of the engine and positioned to be driven by contact of the V-groove of pulley wheel with any desirable portion of the fan and alternator drive belt, so as to rotate the installed aerator shaft assembly 36 in a clockwise direction at various speeds.

The cylindrical aerator members 38 and 39 secured to the central shaft of the aerator assembly are similar in size and form each consisting of a cylindrical of a peripheral wall portion having a central counterbore extending about two-thirds its overall length in depth thus forming integral transverse end walls that are provided with a plurality of radially equally spaced bored 38' and 39'. These bore holes are spaced to communicate with bore 12 of casing 11 at one end and with the individual radial spaces formed by a plurality of angularly arranged fins or turbulators 38'' and 39'' that are secured in the counterbore portions of the cylindrical aerators. It should be noted that aerators 38 and 39 are positioned and secured on the central shaft member 37 with their bored holes and their radial fins or turbulators facing in opposite directions and the rear face of aerator 38 is provided with a suitable circular screen 52. The purpose of the aerator design and particular positioning on the central shaft will become evident as this description proceeds.

The gas aerator assembly 10 also includes the float assembly 35 comprising the usual float chamber 34' which is provided near its lower end with an integral transverse web or spider 53 that is open to both upper and lower portions of the float chamber. Spider 53 functions as a stop or rest member for the vertically movable float member 54 which is provided at its top end with a tapered metering stem 55 which is adapted to open or close the central vertical passage or bore 56 in a suitable cylindrical closure member 57 that is removably secured in sealed relationship at the top end of the float chamber 34' by a suitable O-ring and screws 58 and 59.

Attached to the top surface of closure member 57 by means of a suitable fitting 60 is the usual fuel supply line 61 that furnishes the fuel from a conventional fuel pump (not shown) to the float chamber 34' through the passage 56 in the closure member. A fitting 62 having a small central bore 63 is removably secured in horizontal relationship to the lower portion of the cylindrical casing 34 so that its central bore communicates with the lower portion of the float chamber 34'. Fitting 62 is removably attached in leak proof relationship to the flat milled sides at the bottom end of the solid vertical circular fitting 64. Fitting 64 is provided with a small central bore 65 and is rigidly attached to the circular wall of air-horn 13 at which point another horizontal central bore 66 is drilled through the vertical fitting 64 and into the bore 13' of this air-horn so that the lower portion of float chamber 34', bore 63 in the fitting 62, bore 65 in fitting 64 and bore 66 which communicates with bore 13' of air-horn 13 are all direct communication with each other. The flow of fuel through these bores is adjustably controlled or stopped entirely by suitable upper and lower metering screws 67 and 68, respectively. A drain plug 69 is screwed into the bottom end of the vertical fitting 64, as shown in FIG. 2 of the drawings.

Bore 13' of air-horn 13 is provided with a small tubular member 70 having a plurality of small holes into the bore of which the squared end of the stem of the upper metering screw 67 extends and which serves as an atomizer for the fuel passing through the horizontal bore 66 into the same.

OPERATION AND FUNCTION

A fuel system for an internal combustion engine having the gas aerator of this invention incorporated as the principal component of the system is operated and functions in a manner similar to those systems which employ a conventional carburetor, with one extremely important exception or difference. At no time during the operation of the engine (except possibly at the initial starting) is unvaporized fuel allowed to enter the air-horn which feeds the combustible air-fuel mixture to the combustion chambers of the cylinders of the engine.

Initial starting of the engine is accomplished by the usual pumping of the accelerator or other control mechanism which causes liquid fuel to be forced from an auxiliary pump (not shown) in the form of a spray through the atomizing nozzle 32 into the interior bore 17 of the large air-horn 18. At this point the fuel is picked up and further vaporized by the movement of air passing past the slightly opened choke butterfly valve 20 and the open throttle butterfly valve 22 into the intake manifold 28 from which it is distributed to the combustion chambers of the cylinders where it is ignited in the usual manner.

After the initial starting of the engine is accomplished and its crank shaft and associated fan and alternator V belt rotated, the pulley wheel (not shown) previously described which is in contact with the V belt imparts a rotary motion to the inner rotatable element 49' of the flexible shaft 49. This action rotates central shaft member 37 to which it is attached and the other components of the aerator shaft assembly 36 secured thereto. This action results in the rotation of the aerator assembly 10 in bore 12 of the cylindrical casing 11 which is then utilized to feed a highly volatile, completely vaporized air-fuel mixture to the large air-horn 18, intake manifold 28, and the combustion chambers of the cylinders of the engine in controlled degrees according to the speed and load requirements of the engine.

In order to accomplish the desirable results described in the above paragraph, liquid fuel is supplied to float chamber 34' through the fuel line 61 by the action of the fuel pump (not shown) until float 54 moves a sufficient distance to allow its tapered metering stem to close passage 56 in closure member 57. The intermittent opening and closing of passage 56 caused by the raising and lowering of the float results in maintaining the proper level of liquid fuel in the float chamber. By virtue of its communication with the horizontal bore 63 in the fitting 62 and the vertical bore 65 in the fitting 64 (as indicated by the fuel level line 71 in FIG. 2 of the drawing) the liquid fuel level is maintained in the vertical bore 65 of fitting 64 as long as the engine is operating.

When the throttle valve 22 in the large air-horn 18 and the small valve 25 in the secondary air-horn 13 are opened simultaneously by the action of the accelerator, clean air is drawn through the air cleaner 27 into the bore 17 of the air-horn 18 and through a suitable air cleaner secured to the open end of the small secondary air-horn 13 into its bore 13' where it mixes with the spray of liquid fuel, drawn into and emerging from the plurality of small holes in the tubular member 70 secured in its bore. This causes a partially atomized air-fuel mixture to be drawn into the confines of bore 12 of the cylindrical casing 11 through the opening 15 by the suction or vacuum created by the revolving fan or impeller 40. The atomized air-fuel mixture will vary according to the speed requirements of the engine satisfied by the degree of opening of the respective throttle valves 22 and 25.

When the partially vaporized air-fuel mixture enters bore 12 of the aerator casing, it is caused to move therethrough under pressure in a whirling, spiral path entering and passing through the plurality of large bored holes 38' in the front face of the cylindrical aerator member 38. The air-fuel mixture then passes between the angular spaces formed by the fins or turbulators 38'' and through screen 52 attached to the rear face thereof resulting in a further turbulence of the air-fuel mixture passing therethrough. A pressure differential also exists between the receiving and exiting ends of the aerator members and hence further mixing or atomizing of the flowing air-fuel mixture occurs as it moves along its spiral path.

After passing through the aerator member 38, the moving air-fuel mixture is forced to impinge on the angular fins or turbulators 39'' of the aerator member 39. The rotary movement of aerator member 39 causes the flowing air-fuel mixture to pass through bored holes 39' in its rear face again resulting in a differential of pressure at both ends of the same and increases the speed of the flowing mixture as it passes therethrough resulting in still greater turbulence and thorough atomization of the same. As the air-fuel mixture continues its whirling, spiraling flow through bore 12 of the aerator casing 11 it is again picked up by the blades of the rear most fan or impeller 41 causing its speed of flow to be increased and impingement on the vanes 42' of the rotating aerator member 42. Member 42 causes greater turbulence and still further atomization of the air-fuel mixture as it is drawn through the hollow connector piece 19 into the bore 17 of the large air-born 18, past the open throttle valve 22, through the opening 29 and into the intake manifold 28 from whence it is distributed to the combustion chambers of the cylinders of the engine under pressure as a thoroughly atomized highly volatile gas air mixture which is capable of supporting complete and non-polluting combustion or burning of the fuel.

It should be noted that the finely atomized air-fuel mixture passing into the combustion cylinder of the cylinders from the aerator assembly 10 is further enhanced in its burning qualities by additional oxygen bearing air that is drawn into the large air-horn 18 by the vacuum created by its venturi 17' which is located approximately at the point of entry of the air-fuel mixture from the aerator into air-horn and thence through the intake manifold into the combustion chambers of the cylinders where it is completely burned.

Although only one embodiment of the present invention has been illustrated and described, it will be apparent to those skilled in the art that various changes and modifications may be made therein without departing from the spirit of the invention or from the scope of the appended claims.

What is claimed is:

1. A fuel aerating carburetor for internal combustion engines comprising:

an elongated hollow cylindrical housing for rotatably receiving a driven shaft suitably journaled along its longitudinal axis, a driven shaft rotatably journaled along the longitudinal axis of said housing, at least one pair of aerating members mounted on said shaft for rotation therewith, said aerating members being spacedly mounted on said shaft and each comprising a cylindrical casing having a plurality of spacedly arranged bores in one end thereof and a plurality of radial fins arranged in the other end thereof, said fins of the first aerating member in the direction of air-fuel mixture through said housing being juxtapositioned to the bores in said second aerating member, said radial fins receiving an air-fuel mixture on one side thereof and thoroughly mixing and atomizing said mixture as it passes therethrough, an inlet port for receiving and mixture at one end of said housing and an outlet port at the other end of said housing, said inlet port being connected to a first air-horn which furnishes an air-fuel mixture to said carburetor, said outlet port being connected to a second air-horn of a second carburetor of an internal combustion engine for transmitting thereto said thoroughly mixed air-fuel mixture, and means connected to said shaft for rotation thereof.

2. The fuel aerating carburetor set forth in claim 1 in further combination with:

two fans mounted on said shaft for rotation therewith, one of said fans being mounted on said shaft between said inlet port and said first aerating member and the other fan being mounted on said shaft between said outlet port and said second aerating member.

3. A fuel atomizing system for internal combustion engines comprising:

a first carburetor, a second fuel carburetor, said second carburetor comprising, an elongated hollow cylindrical housing for rotatably receiving a driven shaft suitably journaled along its longitudinal axis, a driven shaft rotatably journaled along the longitudinal axis of said housing, said shaft having at least a pair of aerating members mounted on said shaft for rotation therewith, said aerating members being spacedly mounted on said shaft and each comprising a cylindrical casing having a plurality of spacedly arranged bores in one end thereof and a plurality of radial fins arranged in the other end thereof, said fins of the first aerating member in the direction of air-fuel mixture through said housing being juxtapositioned to the bores in said second aerating member, said radial fins receiving an air-fuel mixture on one side thereof and thoroughly mixing and atomizing said mixture as it passes therethrough, an inlet port for receiving said mixture at one end of said housing and an outlet port at the other end of said housing, said inlet port being connected to a first air-horn which furnishes an air-fuel mixture to said carburetor, said outlet port being connected to a second air-horn of said first carburetor for transmitting thereto said thoroughly mixed air-fuel mixture, and means connected to said shaft for rotation thereof, a throttle valve in said first air-horn, a throttle valve in said second air-horn, and means for operating said throttle valves in unison.

4. The fuel atomizing system set forth in claim 3 wherein:

said throttle valves are opened simultaneously the same amount in each air horn.

* * * * *